US005269661A

United States Patent [19]

Iizuka et al.

[11] Patent Number: 5,269,661

[45] Date of Patent: Dec. 14, 1993

[54] SCROLL TYPE FLUID DISPLACEMENT APPARATUS HAVING A CAPACITY CONTROL MECHANISM

[75] Inventors: Jiro Iizuka, Takasaki; Ochiai Yoshihiro, Tomioka, both of Japan

[73] Assignee: Sanden Corporation, Gunma, Japan

[21] Appl. No.: 883,382

[22] Filed: May 15, 1992

[30] Foreign Application Priority Data

May 15, 1991 [JP] Japan ..... 3-138691

[51] Int. Cl.[5] ..... F04B 49/00

[52] U.S. Cl. ..... 417/310; 417/440; 418/55.1

[58] Field of Search ..... 417/310, 440; 418/55.1

[56] References Cited

U.S. PATENT DOCUMENTS 5,049,044 9/1991 Hirano ..... 417/310

FOREIGN PATENT DOCUMENTS 0009350 3/1979 European Pat. Off. .
60-243388 12/1985 Japan .
61-190183 8/1986 Japan .

*Primary Examiner*—Richard A. Bertsch
*Assistant Examiner*—Alfred Basichas
*Attorney, Agent, or Firm*—Baker & Botts

[57] ABSTRACT

A scroll type fluid displacement apparatus, in particular, a scroll type compressor, is disclosed. The apparatus includes a pair of scroll members at an angular and radial offset for forming fluid pockets, each scroll member having a spiral element. A bypass hole is provided on a wall of at least one of the spiral elements of the scroll members for communicating between the fluid pockets and a suction chamber. A valve mechanism, which operates in a radial direction, controls the opening and closing of the bypass hole. The valve mechanism is responsive to the rotational motion of the scroll members and/or the pressure in at least one of the fluid pockets. When the apparatus is driven at excessive speed, the valve mechanism operates in response to centrifugal force to open the bypass hole. The compressed fluid in the fluid pockets then is released into the suction chamber through the opened bypass hole, and the compression capacity is reduced to a proper value. Additionally, when the pressure in the fluid pockets becomes excessive, the valve mechanism operates to open the bypass hole to thereby decrease the pressure a proper value.

12 Claims, 3 Drawing Sheets

SCROLL TYPE FLUID DISPLACEMENT APPARATUS HAVING A CAPACITY CONTROL MECHANISM

BACKGROUND OF THE INVENTION

1. Field of the Invention

The present invention relates to a scroll type fluid displacement apparatus, and more particularly to a mechanism for preventing the occurrence of excessive capacity and pressure in such fluid displacement apparatus.

2. Description of the Prior Art

Scroll type fluid displacement apparatuses are well known in the prior art. Generally, a scroll type fluid displacement apparatus has a first scroll member having a first spiral element and a second scroll member having a second spiral element. The first and second spiral elements are interfitted at an angular and radial offset to make a plurality of line contacts which define at least one pair of sealed off fluid pockets. The fluid pockets are moved inwardly along the spiral elements and changed in volume or displaced by relative orbital motion between the first and second scroll members. The scroll type fluid displacement apparatus includes a suction chamber formed in a housing for receiving the fluid which forms the fluid pockets, and a discharge chamber formed in the housing for discharging the displaced fluid.

There are two basic types of scroll type fluid displacement apparatuses. One basic type is a fixed system scroll type fluid displacement apparatus. In this type of scroll type fluid displacement apparatus, one of the scroll members is fixedly disposed within a housing (the "fixed scroll member") and the other scroll member is disposed for nonrotatable orbital movement relative to the fixedly disposed scroll member (the "orbiting scroll member). The other basic type scroll type fluid displacement apparatus is a full rotational system scroll type fluid displacement apparatus. In this type of scroll type fluid displacement apparatus, both scroll members are rotated.

The rotational axis of the first scroll member and the rotational axis of the second scroll member are offset by a length corresponding to the radius of the relative orbital movement of the scroll members. The scroll members rotate substantially synchronously while performing the relative orbital motion.

In conventional scroll type fluid displacement apparatuses, particularly in the conventional full rotational system scroll type fluid displacement apparatus which may be used as a compressor in an air conditioner for a vehicle, the capacity and power consumption of the compressor increases undesirably when the compressor is rotated at a high speed. As a result, the load on an engine of the vehicle increases and it becomes difficult for the air conditioner to deliver a comfortable level of air conditioning.

Moreover, in both basic types of conventional scroll type fluid displacement apparatuses, when fluid pressure increases significantly, that is, when compression of the fluid is excessive, the apparatus may be damaged. The occurrence of excessive pressure decreases the durability of the apparatus.

In fixed system scroll type fluid displacement apparatuses, mechanisms have been provided for reducing the capacity of the compressor when the compressor is rotated at a high speed. Such a mechanism is disclosed in JP-B-SHO 56-32468 and depicted in FIG. 3 of the appended drawings. In the compressor of FIG. 3, capacity reduction mechanism 301 is provided to release pressure.

This mechanism, which comprises hole 302, ball 303 and spring 304, is provided at a central portion of end plate 305 of orbiting scroll member 306. Hole 302 provides fluid communication between fluid pocket 307 and suction chamber 308 when ball 303, which is biased by spring 304, is radially moved in response to centrifugal force.

In the above compressor, however, there are a number of disadvantages to the use of capacity reduction mechanism 301. First, since capacity reduction mechanism 301 is provided at the central portion of the scroll member, the high pressure of the compressed fluid cannot be reduced unless the compressed fluid reaches the central portion. If excessive pressure is generated before the compressed fluid reaches the central portion, excessive pressure still is applied to the scroll members including fixed scroll member 309. Moreover, since the reduction in capacity is performed by releasing the compressed fluid into suction chamber 308 through hole 302 after actual compression, fluid at high-temperature and high-pressure enters the suction chamber. As a result, the temperature of the compressor increases excessively and the durability of the compressor is reduced. Lastly, it is noted that the direction of the centrifugal force for moving ball 303 is different from the direction of the urging force of spring 304. Therefore, it is difficult to properly control the opening and closing of hole 302 with ball 303 as a function of rotational speed.

SUMMARY OF THE INVENTION

Accordingly, an object of the present invention is to provide a scroll type fluid displacement apparatus having a mechanism capable of preventing the fluid displacement apparatus from experiencing excessive capacity and pressure, thereby reducing the power required for driving the fluid displacement apparatus and increasing the durability of the fluid displacement apparatus.

To achieve this object, a scroll type fluid displacement apparatus according to the present invention is herein provided.

The scroll type fluid displacement apparatus includes a housing having therein a suction chamber and a discharge chamber, a first scroll member disposed within the housing and having a first end plate from which a first spiral element axially extends into the interior of the housing and a second scroll member disposed for nonrotatable orbital movement relative to the first scroll member and having a second end plate from which a second spiral element axially extends into the interior of the housing. The first and second spiral elements interfit at an angular and radial offset to make a plurality of line contacts which define at least one pair of sealed off fluid pockets. A drive mechanism is operatively connected to at least one of the first and second scroll members to effect relative orbital motion between the first and second scroll members and the line contacts whereby the fluid pockets move inwardly and change in volume. A fluid is sucked from the suction chamber to the fluid pockets and discharged from the fluid pockets to the discharge chamber. A bypass hole is provided on a wall of at least one of the first and second spiral elements for communicating between at least one of the fluid pockets and the suction chamber. A valve mechanism is provided for controlling opening and closing of the bypass hole depending on rotational motion of the first and second scroll members and/or depending on the pressure of the fluid pocket.

In the scroll type fluid displacement apparatus according to the present invention, the above bypass hole is formed on an axially extending wall of at least one of the first and second spiral elements. The valve mechanism controls opening and closing of the bypass hole. In a full rotational system scroll type fluid displacement apparatus, the valve mechanism is responsive to the rotational motion of the first and second scroll members and/or the pressure of at least one of the fluid pockets. In a fixed system scroll type fluid displacement apparatus, the valve mechanism is responsive to the pressure of at least one of the fluid pockets.

When the full rotational system scroll type fluid displacement apparatus is driven at a high rotational speed, the valve mechanism opens the bypass hole in response to centrifugal force. Since the bypass hole is formed on an axially extending wall of a spiral element, the bypass hole has a radial extension. Accordingly, centrifugal force is efficiently applied to the valve mechanism for opening and closing such radially directed bypass hole. When the valve mechanism opens the bypass hole, the bypass hole provides fluid communication between at least one of the fluid pockets and the suction chamber so that compressed fluid in the fluid pocket is released into the suction chamber. Therefore, the capacity of the fluid displacement apparatus is substantially reduced when the apparatus is driven at high speed. As a result, the load required to drive the fluid displacement apparatus, for example, an engine of a vehicle, can be reduced.

In both the full rotational system scroll type fluid displacement apparatus or the fixed system scroll type fluid displacement apparatus, the above described valve mechanism opens the bypass hole in response to excessive pressure. The excessive pressure in the fluid pockets is released into the suction chamber through the opened bypass hole. Therefore, the pressure in the fluid pockets is decreased. Thus, the durability of the scroll members and the fluid displacement apparatus can be increased.

Preferred exemplary embodiments of the invention will now be described with reference to the accompanying drawings, which are given by way of example only, and are not intended to limit the present invention.

DETAILED DESCRIPTION OF THE PREFERRED EMBODIMENTS OF THE INVENTION

Figure 1:
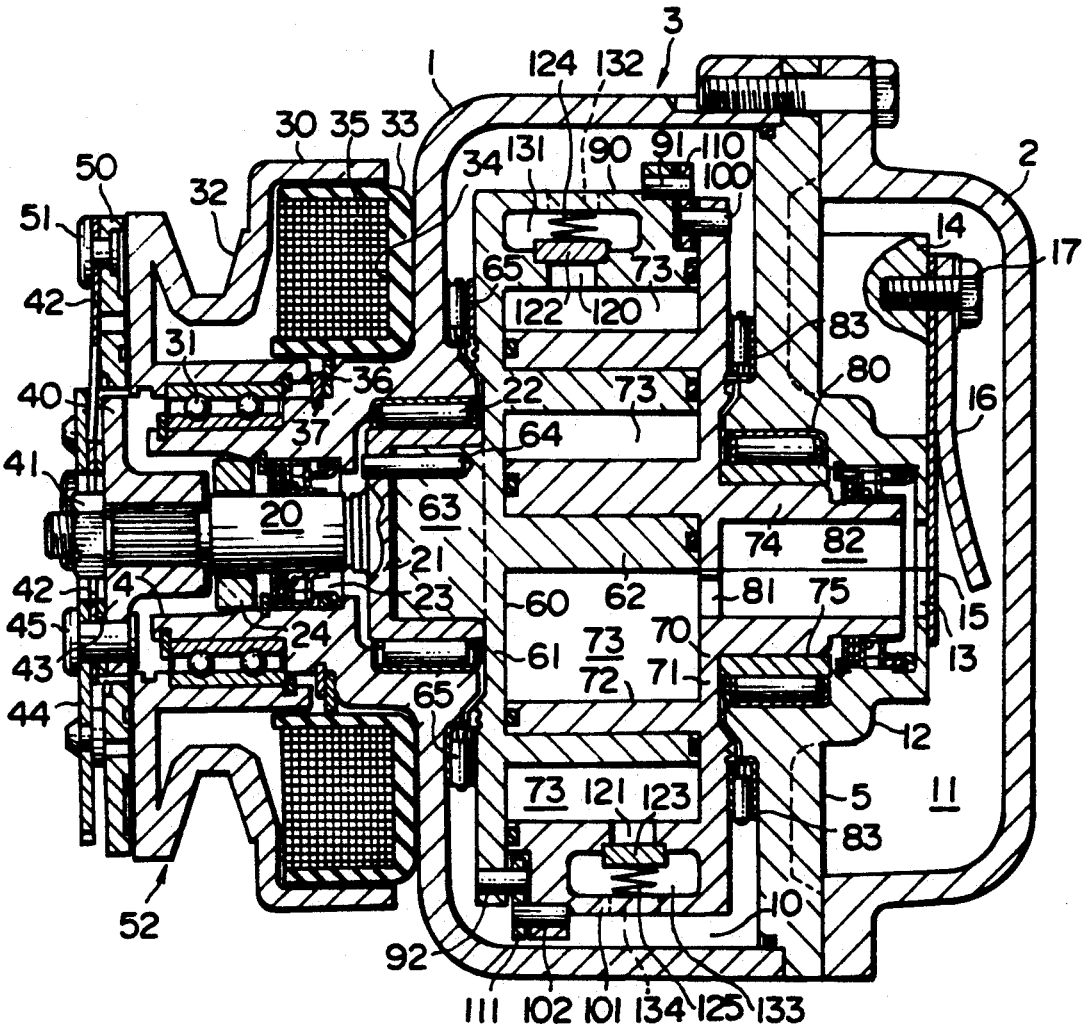
FIG. 1 is a vertical sectional view of a full rotational system scroll type fluid displacement apparatus according to a first embodiment of the present invention.

FIG. 1 illustrates a full rotational system scroll type fluid displacement apparatus according to a first embodiment of the present invention. The illustrated apparatus is designed to operate as a scroll type compressor. The compressor includes housing 3 comprising housing body 1 and cylinder head 2. Boss 4 is formed on one end of housing body 1. Partition plate 5 is interposed between housing body 1 and cylinder head 2.

The interior of housing 3 is partitioned into suction chamber 10 and discharge chamber 11. Bearing portion 12 is formed on the central portion of partition plate 5. Hole 13 is defined in bearing portion 12. Attaching portion 14 is formed on the cylinder head side surface of partition plate 5. Reed valve 15 and valve retainer 16 for regulating the motion of the reed valve are attached by bolt 17 on attaching portion 14.

Main shaft 20 is rotatably provided in boss 4. Main shaft 20 has engaging portion 21 at one end thereof. Engaging portion 21 is rotatably supported by needle bearing 22 which is attached in boss 4. Seal member 23 and felt member 24 are disposed between boss 4 and main shaft 20.

Clutch rotor 30 is rotatably supported on boss 4 of housing body 1 via ball bearing 31. Clutch rotor 30 has V-shaped groove 32. Clutch rotor 30 is rotated by a drive source via a V-belt (not shown). The drive source may be an external engine such as the engine of an automobile.

Yoke 33 is provided on boss 4. Yoke 33 is formed as a ring-like member and has groove 34 along the ring-like member. Ring-shaped coil 35 is provided in groove 34. Ring plate 36 is fixed to the inner surface of yoke 33. Yoke 33 is fixed to boss 4 by ring plate 36 via snap ring 37.

Armature boss 40 is fixed to the end portion of main shaft 20 by nut 41. Stopper plate 44 is fixed to the side surface of armature boss 40 by rivet 45 interposing one end of leaf spring 42 and spacer 43. Ring-shaped armature 50 is attached to the other end of leaf spring 42 by rivet 51. Therefore, armature 50 is elastically supported by leaf spring 42 and can move in a direction along the axis of main shaft 20. Armature 50 faces the end surface of clutch rotor 30. Armature 50 can contact with or separate from the end surface of clutch rotor 30 by the axial movement of the armature. Clutch rotor 30, yoke 33, coil 35, armature boss 40 and armature 50 etc. constitute electromagnetic clutch 52.

First scroll member 60 comprises first end plate 61 and first spiral element 62. First end plate 61 is formed as a circular plate. First spiral element 62 is provided on one surface of first end plate 61 such that the first spiral element 62 axially extends into the interior of housing 3. Shaft portion 63 is formed on the other surface of first end plate 61. Shaft portion 63 is disposed in engaging portion 21 of main shaft 20 and connected to the engaging portion by pin 64.

First scroll member 60 rotates together with main shaft 20 by this connection. Thrust needle bearing 65 is interposed between the other surface of first end plate 61 and the inner surface of housing 1.

Second scroll member 70 comprises second end plate 71 and second spiral element 72. First spiral element 62 of first scroll member 60 and second spiral element 72 of second scroll member 70 are interfitted at an angular and radial offset to make a plurality line contacts which define at least one pair of sealed off fluid pockets 73. Second end plate 71 is formed as a circular plate. Second spiral element 72 is provided on one surface of second end plate 71 such that the second spiral element 72 axially extends into the interior of housing 3. Shaft portion 74 is formed on the other surface of second end plate 71. Shaft portion 74 is inserted into spacer 75 provided in needle bearing 80 which is provided in bearing portion 12 of partition plate 5. Second scroll member 70 can be rotated by this supporting structure. The rotational axis of second scroll member 70 is offset relative to the rotational axis of first scroll member 60. The offset is equal to the radius of the relative orbital motion of the first and second scroll members.

Shaft portion 74 has a hollow structure. Hollow portion 76 communicates with fluid pocket 73 through communicating hole 81 and discharge chamber 11 through hole 13. Hollow portion 76, communicating hole 81 and hole 13 constitute communicating path 82 which provides fluid communication between fluid pocket 73 and discharge chamber 11, and introduces the compressed fluid in the fluid pocket into the discharge chamber. Thrust needle bearing 83 is interposed between second end plate 71 and partition plate 5.

Support portion 90 having cavity 131 is formed on the radially outermost portion of first spiral element 62. Cavity 131 communicates with suction chamber 10 through communicating hole 132. First side pin 91, which extends in a direction along the axis of main shaft 20, is provided on the side portion of support portion 90. Another first side pin 92, which extends in a direction along the axis of main shaft 20, is provided on the radially outermost portion of first end plate 61. Pins 91 and 92 are arranged in a plane passing through the rotational axis of first scroll member 60.

Second side pin 100, which extends in a direction along the axis of main shaft 20, is provided on the radially outermost portion of second end plate 71, in correspondence with first side pin 91. Support portion 101 having cavity 133 is formed on the radially outermost portion of second spiral element 72.

Cavity 133 communicates with suction chamber 10 through communicating hole 134. Another second side pin 102, which extends in a direction along the axis of main shaft 20, is provided on the side portion of support portion 101, in correspondence with first side pin 92. Pins 100 and 102 are arranged in a plane passing through the rotational axis of second scroll member 70.

First side pin 91 and second side pin 100 are connected by ring 110 surrounding these pins. Similarly, first side pin 92 and second side pin 102 are connected by ring 111 surrounding these pins.

Radially extending bypass holes 120 and 121 ar provided in support portions 90 and 101, respectively. Namely, bypass holes 120 and 121 are formed on walls of the radially outermost portions of first and second spiral elements 62 and 72. Bypass hole 120 enables fluid pocket 73 to communicate with cavity 131 and bypass hole 121 enables fluid pocket 73 to communicate with cavity 133. A valve mechanism is provided in each of cavities 131 and 133 for controlling opening and closing of each of bypass holes 120 and 121. One valve mechanism comprises valve body 122 which opens and closes bypass hole 120 and spring 124 which urges the valve body in a direction that normally closes the bypass hole, that is, radially inwardly. Valve body 122 and spring 124 are radially arranged. The other valve mechanism comprises valve body 123 which opens and closes bypass hole 121 and spring 125 which urges the valve body in a direction that normally closes the bypass hole, that is, radially inwardly. Valve body 123 and spring 125 are radially arranged.

In the above described compressor, the distance from the rotational axis of first scroll member 60 (first rotational axis) to first side pin 91 is equal to the distance from the rotational axis of second scroll member 70 (second rotational axis) to second side pin 100. First side pin 91 and second side pin 100 are positioned in a plane passing the first rotational axis and the second rotational axis. First side pin 91 revolves around the first rotational axis and second side pin 100 revolves around the second rotational axis. Since first side pin 91 and second side pin 100 are connected by ring 110, first scroll member 60 and second scroll member 70 are rotated synchronously under an eccentric condition. Second side pin 100 moves in a relative nonrotatable orbital motion around first side pin 91. Similarly, first side pin 91 moves in a relative nonrotatable orbital motion around second side pin 100. Thus, in spite of the rotational motion of first and second scroll members 60 and 70, a relative orbital movement is performed between the first and second scroll members.

In this embodiment, although pins 91, 92, 100 and 102 and rings 110 and 111 are used as means for synchronizing first and second scroll members 60 and 70, other means may be used. For example, the first and second scroll members may be synchronized by gears or timing belts. Alternatively, the first and second scroll members may be driven and synchronized by a single drive source.

When the above compressor is driven by a drive source, for example, an engine of a vehicle, first and second scroll members 60 and 70 are rotated in a synchronous condition while a relative orbital movement is performed between the scroll members. The fluid is sucked into fluid pockets 73 from suction chamber 10. The sucked fluid is transferred radially inwardly to form fluid pockets 73 which move inwardly and change in volume. The transferred fluid is compressed as fluid pockets 73 move inwardly and the compressed fluid is discharged into discharge chamber 11. Valve bodies 122 and 123 are responsive to the centrifugal force generated by the rotation of first and second scroll members 60 and 70. If the centrifugal force becomes greater than the urging force of springs 124 and 125, valve bodies 122 and 123 are radially moved outwardly and open bypass holes 120 and 121. When bypass holes 120 and 121 are Opened, the fluid in fluid pockets 73 is released into suction chamber 10 through the opened bypass holes, cavities 131 and 133 and holes 132 and 134. As a result, compression capacity is substantially decreased. Namely, when the driving source (the engine) is driven at a high speed (an excessive speed for the compressor), the capacity of the compressor is automatically reduced. Therefore, an unnecessarily large load is not applied to the engine.

On the other hand, when abnormal fluid compression occurs, and the pressure in fluid pockets 73 becomes excessive, i.e., over a predetermined limited pressure, valve bodies 122 and 123 are radially moved outwardly against the urging forces of springs 124 and 125 to open bypass holes 120 and 121. The compressed fluid then escapes into suction chamber 10 through the opened bypass holes, cavities 131 and 133 and holes 132 and 134. As a result, the pressure in fluid pockets 73 is reduced to a proper value, and the durability of the compressor, specifically the scroll members, is improved.

Figure 2:
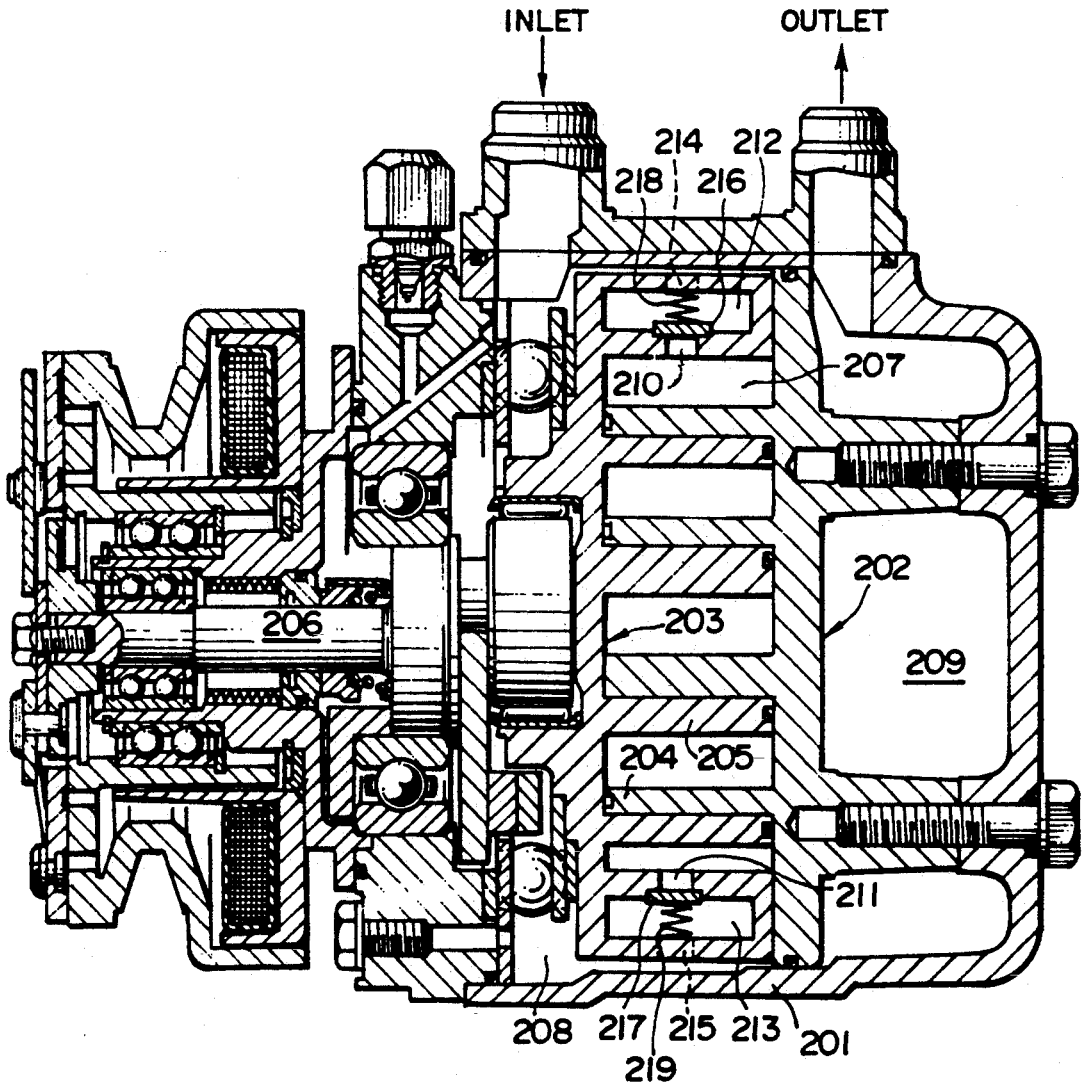
FIG. 2 is a vertical sectional view of a fixed system scroll type fluid displacement apparatus according to a second embodiment of the present invention.
Figure 3:
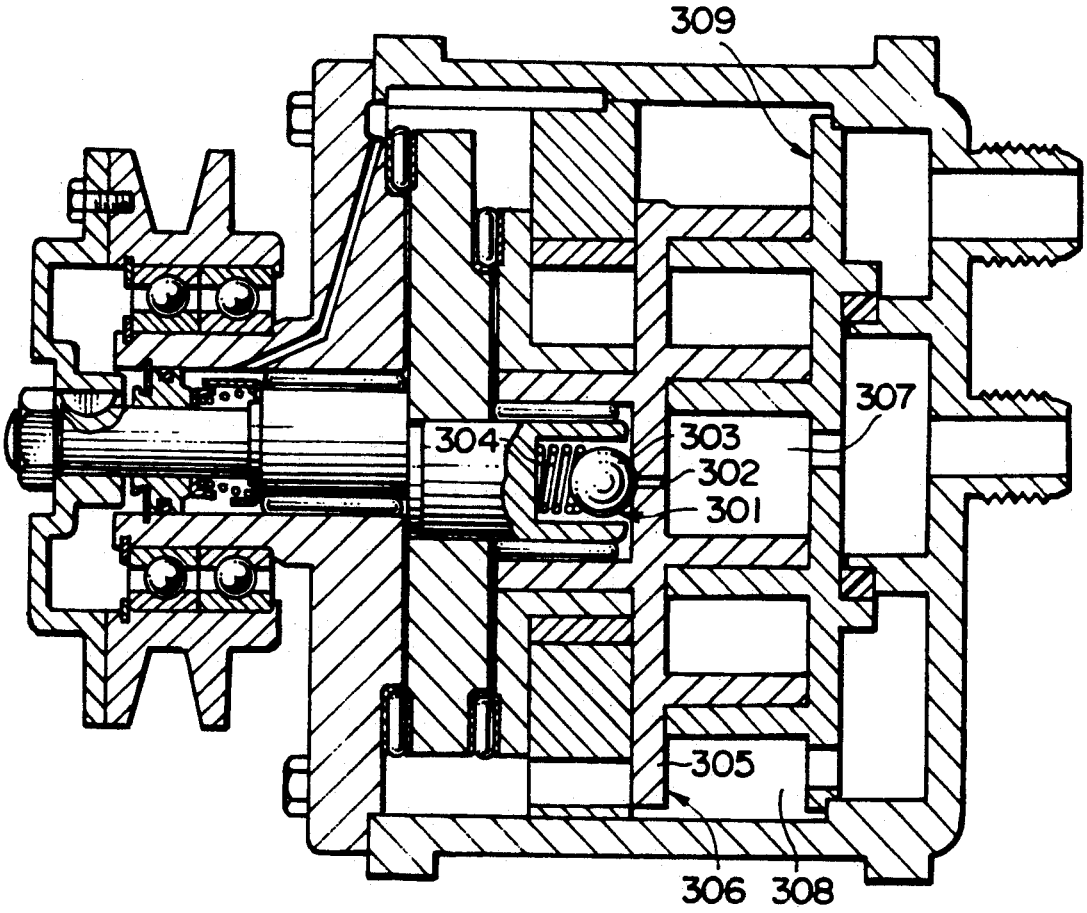
FIG. 3 PRIOR ART
FIG. 3 is a vertical sectional view of a conventional fixed system scroll type compressor.

FIG. 2 illustrates a fixed system scroll type fluid displacement apparatus according to a second embodiment of the present invention. The illustrated apparatus also is designed to operate as a scroll type compressor. The compressor includes housing 201, fixed scroll member 202 and orbiting scroll member 203. Spiral element 204 of fixed scroll member 202 and spiral element 205 of orbiting scroll member 203 interfit. Orbiting scroll member 203 is driven by drive shaft 206 so that the orbiting scroll member is moved in a nonrotatable orbital motion relative to fixed scroll member 202.

Fluid pockets 207 move radially inwardly upon orbital movement of orbiting scroll member 203 to compress the fluid sucked from suction chamber 208. The compressed fluid is discharged into discharge chamber 209.

In the fixed system scroll type compressor, radially extending bypass holes 210 and 211 are provided on walls of the radially outermost portions of spiral element 205 of orbiting scroll member 203. Bypass hole 210 communicates between fluid pocket 207 and cavity 212 which communicates with suction chamber 208 through hole 214. Bypass hole 211 communicates between fluid pocket 207 and cavity 213 which communicates with suction chamber 208 through hole 215. A valve mechanism is provided in each of cavities 212 and 213 for controlling opening and closing of each of bypass holes 210 and 211. One valve mechanism comprises valve body 216 which opens and closes bypass hole 210 and spring 218 which urges the valve body in a direction that normally closes the bypass hole, that is, radially inwardly. Valve body 216 and spring 218 are radially arranged. The other valve mechanism comprises valve body 217 which opens and closes bypass hole 211 and spring 219 which urges the valve body in a direction that normally closes the bypass hole, that is, radially inwardly. Valve body 217 and spring 219 are radially arranged.

In such a compressor, when abnormal fluid compression occurs, and the pressure in fluid pockets 207 becomes excessive, i.e., over a predetermined limited pressure, valve bodies 216 and 217 are radially moved outwardly against the urging forces of springs 218 and 219 to open bypass holes 210 and 211. The compressed fluid then escapes into suction chamber 208 through the opened bypass holes, cavities 212 and 213 and holes 214 and 215. As a result, the pressure in fluid pockets 207 is reduced to a proper value, and the durability of the compressor, specifically the scroll members, is improved.

Although several preferred embodiments of the present invention have been described in detail herein, it will be appreciated by those skilled in the art that various modifications can be made without materially departing from the novel and advantageous teachings of the invention. Accordingly, the embodiments disclosed herein are by way of example. The scope of the invention is defined by the claims annexed hereto and forming a part of this application.

We claim:

1. In a scroll type fluid displacement apparatus including a housing having therein a suction chamber and a discharge chamber, a first scroll member disposed within said housing and having a first end plate from which a first spiral element axially extends into the interior of said housing, a second scroll member disposed for nonrotatable orbital movement relative to said first scroll member within the interior of said housing and having a second end plate from which a second spiral element axially extends into the interior of said housing, said first and second spiral elements interfitting at an angular and radial offset to make a plurality of line contacts which define at least one pair of sealed off fluid pockets, and a drive mechanism operatively connected to at least one of said first and second scroll members to effect relative orbital motion between said first and second scroll members and said line contacts whereby said fluid pockets move inwardly and change in volume and a fluid is sucked from said suction chamber to said fluid pockets and discharged from said fluid pockets to said discharge chamber, the improvement comprising:

a bypass hole provided on a wall of at least one of said first and second spiral elements for communicating between at least one of said fluid pockets and said suction chamber; and a valve mechanism for controlling the opening and closing of said bypass hole in response to the rotational motion of said first and second scroll members, wherein said scroll type fluid displacement apparatus is a full rotational system scroll type fluid displacement apparatus wherein said first and second scroll members are rotatable.

2. A scroll type fluid displacement apparatus as recited in claim 1 wherein said bypass hole communicates between said at least one fluid pocket and said suction chamber via a cavity formed in at least one of said first and second scroll members.

3. A scroll type fluid displacement apparatus as recited in claim 1 wherein said valve mechanism comprises a valve body for opening and closing said bypass hole and a spring for urging said valve body in a direction that normally closes said bypass hole, said valve body and said spring being radially arranged.

4. A scroll type fluid displacement apparatus as recited in claim 1 wherein said bypass hole is provided on a wall of each of said first and second spiral elements.

5. In a scroll type fluid displacement apparatus including a housing having therein a suction chamber and a discharge chamber, a first scroll member disposed within said housing and having a first end plate from which a first spiral element axially extends into the interior of said housing, a second scroll member disposed for nonrotatable orbital movement relative to said first scroll member within the interior of said housing and having a second end plate from which a second spiral element axially extends into the interior of said housing, said first and second spiral elements interfitting at an angular and radial offset to make a plurality of line contacts which define at least one pair of sealed off fluid pockets, and a drive mechanism operatively connected to at least one of said first and second scroll members to effect relative orbital motion between said first and second scroll members and said line contacts whereby said fluid pockets move inwardly and change in volume and a fluid is sucked from said suction chamber to said fluid pockets and discharged from said fluid pockets to said discharge chamber, the improvement comprising:

a bypass hole provided on a wall of at least one of said first and second spiral elements for communicating between at least one of said fluid pockets and said suction chamber; and a valve mechanism for controlling the opening and closing of said bypass hole in response to the amount of pressure in said at least one fluid pocket, wherein said scroll type fluid displacement apparatus is a full rotational system scroll type fluid displacement apparatus wherein said first and second scroll members are rotatable.

6. A scroll type fluid displacement apparatus as recited in claim 5 wherein said bypass hole communicates between said at least one fluid pocket and said suction chamber via a cavity formed in at least one of said first and second scroll members.

7. A scroll type fluid displacement apparatus as recited in claim 5 wherein said valve mechanism comprises a valve body for opening and closing said bypass hole and a spring for urging said valve body in a direction that normally closes said bypass hole, said valve body and said spring being radially arranged.

8. A scroll type fluid displacement apparatus as recited in claim 5 wherein said bypass hole is provided on a wall of each of said first and second spiral elements.

9. In a scroll type fluid displacement apparatus including a housing having therein a suction chamber and a discharge chamber, a first scroll member disposed within said housing and having a first end plate from which a first spiral element axially extends into the interior of said housing, a second scroll member disposed for nonrotatable orbital movement relative to said first scroll member within the interior of said housing and having a second end plate from which a second spiral element axially extends into the interior of said housing, said first and second spiral elements interfitting at an angular and radial offset to make a plurality of line contracts which define at least one pair of sealed off fluid pockets, and a drive mechanism operatively connected to at least one of said first and second scroll members to effect relative orbital motion between said first and second scroll members and said line contacts whereby said fluid pockets move inwardly and change in volume and a fluid is sucked from said suction chamber to said fluid pockets and discharged from said fluid pockets to said discharge chamber, the improvement comprising:

a bypass hole provided on a wall of at least one of said first and second spiral elements for communicating between at least one of said fluid pockets and said suction chamber; and a valve mechanism for controlling the opening and closing of said bypass hole in response to the rotational motion of said first and second scroll members and the amount of pressure in said at least one fluid pocket, wherein said scroll type fluid displacement apparatus is a full rotational system scroll type fluid displacement apparatus wherein said first and second scroll members are rotatable.

10. A scroll type fluid displacement apparatus as recited in claim 9 wherein said bypass hole communicates between said at least one fluid pocket and said suction chamber via a cavity formed in at least one of said first and second scroll members.

11. A scroll type fluid displacement apparatus as recited in claim 9 wherein said valve mechanism comprises a valve body for opening and closing said bypass hole and a spring for urging said valve body in a direction that normally closes said bypass hole, said valve body and said spring being radially arranged.

12. A scroll type fluid displacement apparatus as recited in claim 9 wherein said bypass hole is provided on a wall of each of said first and second spiral elements.

* * * * *